US009802678B2

(12) United States Patent
Orsello

(10) Patent No.: US 9,802,678 B2
(45) Date of Patent: Oct. 31, 2017

(54) ANCHOR SYSTEMS AND METHODS

(71) Applicant: Tim Orsello, Woodbury, MN (US)

(72) Inventor: Tim Orsello, Woodbury, MN (US)

( * ) Notice: Subject to any disclaimer, the term of this patent is extended or adjusted under 35 U.S.C. 154(b) by 0 days.

(21) Appl. No.: 14/750,722

(22) Filed: Jun. 25, 2015

(65) Prior Publication Data

US 2015/0375827 A1 Dec. 31, 2015

Related U.S. Application Data

(60) Provisional application No. 62/018,322, filed on Jun. 27, 2014.

(51) Int. Cl.
*B63B 21/44* (2006.01)
*B63B 21/34* (2006.01)
*B63B 21/26* (2006.01)

(52) U.S. Cl.
CPC ..... *B63B 21/34* (2013.01); *B63B 2021/262* (2013.01)

(58) Field of Classification Search
CPC ..... B63B 21/24; B63B 21/30; B63B 21/32; B63B 21/34; B63B 21/46
USPC ..... 114/294, 301–303
See application file for complete search history.

(56) References Cited

U.S. PATENT DOCUMENTS 3,043,258 A 7/1962 Sander
3,286,679 A 11/1966 Wood
3,505,969 A 4/1970 Bowers
4,173,938 A * 11/1979 Colin ..... B63B 21/30 114/294
4,210,092 A 7/1980 Battersby
4,700,652 A * 10/1987 Pekny ..... B63B 21/243 114/302
5,154,133 A 10/1992 Hallerberg
5,579,713 A 12/1996 Power
5,622,135 A 4/1997 Eberline, Sr.
5,829,379 A 11/1998 von Spies
5,970,902 A * 10/1999 Francis ..... B63B 21/32 114/294
6,082,284 A * 7/2000 McCabe ..... B63B 21/26 114/301
6,626,123 B1 9/2003 MacKarvich
8,205,569 B2 * 6/2012 Francis ..... B63B 21/32 114/294
8,950,352 B2 * 2/2015 Smith ..... B63B 21/32 114/294

FOREIGN PATENT DOCUMENTS

EP 0376424 12/1989

* cited by examiner

*Primary Examiner* — Andrew Polay

(74) *Attorney, Agent, or Firm* — Brooks, Cameron & Huebsch, PLLC

(57) ABSTRACT

An anchor apparatus including a base comprising a first portion that is positioned at a first level and a second portion that is positioned at a second level that is elevated from the first level, wherein the base includes a back plate that covers a portion between the first level and the second level.

19 Claims, 4 Drawing Sheets

ANCHOR SYSTEMS AND METHODS

TECHNICAL FIELD

The present disclosure relates to anchor systems.

BACKGROUND

An anchor can be used to prevent the movement of an object. For example, an anchor can be used to prevent the movement of a boat. Anchors can include specifications that include a particular scope to prevent movement of a particular size boat during particular conditions. The anchors can utilize a mass, a digging mechanism, and/or a combination thereof to prevent the movement of the particular size boat.

DETAILED DESCRIPTION

Figure 1:
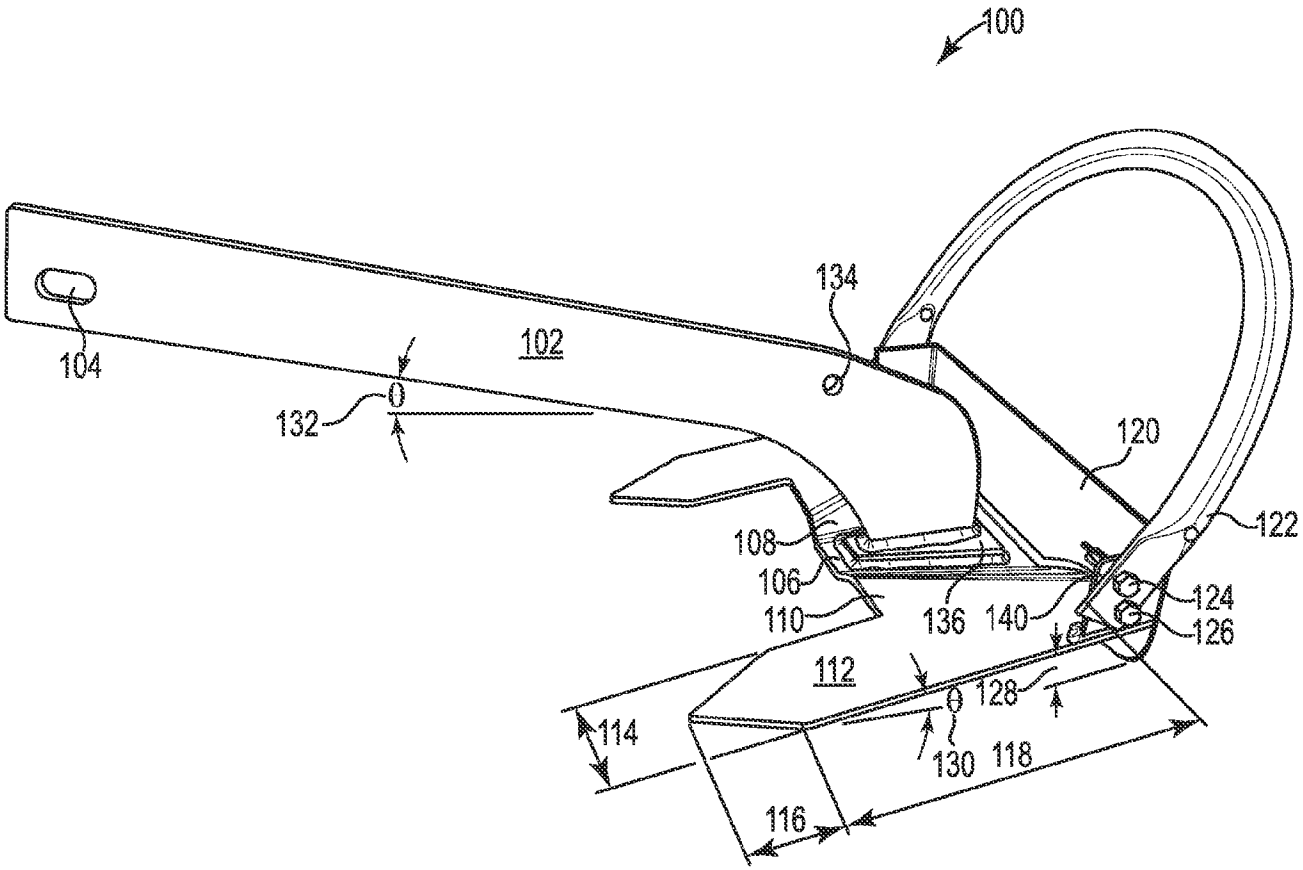
FIG. 1 illustrates an example of a side view of an anchor in accordance with one or more embodiments of the present disclosure.

An anchor, as described herein, can include a base comprising a first portion that is positioned at a first level and a second portion that is positioned at a second level that is elevated from the first level, wherein the base includes a back plate that covers a portion between the first level and the second level.

In some embodiments, the second position of the base is elevated at an angle between approximately 10 degrees and 50 degrees from the first position of the base. In a specific embodiment, the second position of the base is elevated at an angle of approximately 30 degrees from the first position of the base.

In some embodiments, the back end of the anchor comprising the back plate is elevated from a front end of the base. For example, the back end of the anchor can be elevated at an angle between approximately 5 degrees and 20 degrees. In a specific embodiment, the back end of the anchor comprising the back plate is elevated at an angle of approximately 10 degrees. As used herein, a front end of the base and/or anchor can include an end that receives debris and/or an end where force is applied to the anchor. In addition, the back end of the base and/or anchor can include an end that does not receive debris and/or an end opposite where force is applied to the anchor.

The first level and the second level of the anchor with the elevated back end of the anchor can provide a base that acts as a scoop (e.g., spade, additional fluke, digging device, etc.). In addition, with a back plate positioned at a back end of the base, material that is scooped into the base can remain within the base to provided added stopping potential (e.g., resistance, greater quantity of force required to move the anchor, etc.).

The anchor embodiments described herein can provide additional resistance compared to previous anchors. The resistance can be measured in various forms of force energy. For example, the resistance can be measured in foot-pound force. In this example, the resistance can represent an amount of energy that is required to move the anchor. That is, the anchor described herein can require additional energy (e.g., force, etc.) to move the anchor compared to previous anchors.

In addition, the anchor as described herein can provide additional resistance with a smaller scope compared to previous anchors. When used herein, the scope is generally defined as scope equals length of the rode divided by a depth of the water from the bow of the vessel being anchored (e.g., object being anchored, etc.). Accordingly, the scope can include a length of a rode (e.g., rope, chain, leash, etc.) and a depth of water to obtain a corresponding resistance or force that the anchor is capable of producing (e.g., S=L/D or S=L:D where S=scope, L=length of rode, and D=depth of water).

In some embodiments, the scope of the anchor described herein can be a 2:1 scope compared to many other previous anchors that require a scope of 5:1. That is, the length of the rode does not need to be as long to achieve the same level of resistance as previous anchors when utilizing the anchor described herein.

It can be desired to have a shorter rode with the same and/or similar resistance to limit an area where the object can move while attached to the anchor. In addition, the anchor described herein can be utilized with an increased scope (e.g., 5:1, etc.) to obtain even greater resistance compared to other anchors utilizing the same scope.

As used herein, "a" or "a number of" something can refer to one or more such things. For example, "a number of flukes" can refer to one or more flukes.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

Specific embodiments have been disclosed for a particular anchor size range. Even though specific embodiments have been disclosed and illustrated herein, those of ordinary skill in the art will appreciate that anchors of a larger size and/or a smaller size than the specific embodiments. In some cases, the changes in dimensions may not be a linear increase for larger anchors and may not be a linear decrease for smaller anchors. However, portions of the base of the anchors described herein can follow a percentage increase for larger anchors and a percentage decrease for smaller anchors. That is, each portion of the base (e.g., first portion, second portion, raised portion, etc.) can comprise a particular percentage of space and when increasing or decreasing the size, the percentage of space can be maintained to provide similar performance results.

As used herein, the length of objects and/or angles of objects are described with the term "approximately". As used herein, "approximately" indicates a reasonable alteration of the length and/or angles of the objects. For example, a reasonable alteration of the length includes an increase or a decrease of 30 millimeters. In another example, a reasonable alteration of an angle includes an increase or a decrease of 5 degrees.

FIG. 1 illustrates an example of a side view of an anchor 100 in accordance with one or more embodiments of the present disclosure. The anchor 100 can include a fixed shank 102 that is attached to a first portion 106 of a base of the anchor 100. In some embodiments, the fixed shank 102 can be attached to the first portion 106 of the base via a number methods (e.g., metal weld, adhesive, etc.) to permanently or semi-permanently attach the shank 102 to the first portion 106 of the base.

In some embodiments, the fixed shank 102 can be attached to the first portion 106 of the base via a number of removable pins (e.g., bolt/nut combination, etc.). As used herein, the term "fixed" includes an object that is not able to pivot or sway from the "fixed" position. For example, a fixed fluke is a fluke that is in a fixed position and is unable to pivot or sway from the fixed position. In another example, a fixed shank is a shank that is in a fixed position and is unable to pivot or sway from the fixed position.

In some embodiments, the fixed shank 102 can be attached to the first portion 106 at a first level of the base and the back plate 120 of the anchor 100. In some embodiments, the fixed shank 102 can be attached to a back plate 120 of the anchor 100 via a number of removable pins (not shown). In some embodiments, the fixed shank 102 can be attached to the first portion 106 of the base and/or the back plate 120 via a plate 136. The plate 136 can provide additional support for attaching the fixed shank 102 to the first portion 106 of the base. In embodiments where the anchor 100 includes a fixed shank 102 that is attached to the first portion 106 of the base and the back plate 120, the plate 136 can be attached to the first portion 106 of the base and the back plate 120.

In some embodiments, the fixed shank 102 can be positioned at an angle 132 from the base of the anchor 100. In some embodiments the angle 132 can be between approximately 5 degrees and 25 degrees. In certain embodiments, the angle 132 can be between approximately 10 degrees and 20 degrees. In a specific embodiment, the angle can be approximately 15 degrees.

In some embodiments, the second portion 110 at the second level of the base can be elevated at an angle that is between 10 degrees and 50 degrees from the first portion 106 at the first level of the base. In certain embodiments, the second portion 110 of the base can be elevated at an angle that is between 25 degrees and 40 degrees from the first portion 106. In a specific embodiment, the second portion 110 of the base can be elevated at an angle that is approximately 30 degrees from the first portion 106 of the base. Such embodiments can be beneficial as they increase the volume of the section between the elevated portions (e.g., second portions 110, etc.) allowing more debris (sand, dirt, mud, rocks, etc.) to sit on a top portion of the anchor 100. That is, such embodiments can be beneficial as they provide additional volume between the elevated portions.

In some embodiments, the first portion 106 of the anchor 100 can be raise to the second portion 110 of the anchor by a raised portion 108. The raised portion 108 can elevate the base of the anchor 100 from the first level to the second level. In some embodiments, the raised portion 108 can be generated by bending the base into a position that includes the angles described herein.

The second portion 110 of the base can be parallel to the first portion 106. That is, the second portion 110 can be at the same and/or similar angle as the first portion 106. In some embodiments, a fluke 112 can be attached to the second portion 110. In some embodiments, the fluke 112 can be integrally formed with the second portion 110. That is, a portion of the base can be removed to form the number of flukes 112 and the first portion 106 and second portion 110 can be formed by bending the base to provide the particular angles as described herein. In some embodiments, the fluke 112 can be attached via a number of removable pins (e.g., bolt and nut, etc.).

In some embodiments, the number of flukes can have a length 118. The length 118 of the fluke 112 can be measured from the tip 116 of the fluke 112 to the back plate 120. In some embodiments, the length 118 of the fluke 112 can be between approximately 220 millimeters and 260 millimeters. In certain embodiments, the length 118 of the fluke 112 can be between approximately 230 millimeters and 250 millimeters. In a specific embodiment, the length 118 of the fluke 112 can be approximately 245 millimeters.

In some embodiments, there can be multiple flukes 112 at the second level of the base. For example, there can be a first fluke 112 of the base at the second level on a first side (e.g., left side, right side, etc.) of the base and also include a second fluke 112 at the second level of the base on a second side of the base. In such embodiments, a fluke 112 can be attached to each side of the base at the second level. For example, a first fluke 112 can be attached to a portion of the base at the second level on a right side of the anchor 100 and a second fluke 112 can be attached to a portion of the base at the second level on a left side of the anchor 100.

The fluke 112 can include a particular width 114. In some embodiments, the width 114 of the fluke can be between approximately 2 inches and 3 inches. In a specific embodiment, the width 114 of the fluke 112 can be approximately 2.25 inches. The width 114 of the number of flukes 112 can be increased or decreased based on a particular embodiment of the anchor 100. For example, the elements of the anchor 100 can be increased to provide a relatively larger anchor size with increased performance for anchoring a relatively larger object (e.g., object with greater mass, object applying a greater force, etc.). In some embodiments, the width 114 of the fluke 112 can be consistent (e.g., relatively the same width, etc.) from the second portion 110 of the base to a start of the tip 116 (e.g., a position where the tip 116 begins to narrow towards a point, etc.).

The fluke 112 can include a tip 116. The tip 116 of the fluke 112 can include a triangle shaped portion of the fluke 112 that includes an angled portion that narrows to a point. In some embodiments, the tip 116 of the fluke 112 can be utilized to puncture debris below the anchor 100 when force is applied to the fixed shank 102 and/or force is applied to a bottom portion of the back plate 120. The tip 116 of the fluke 112 can be the same and/or similar size as the width 114 of the fluke 112. For example, if the width 114 of the fluke 112 is approximately 2.25 inches, the length of the tip 116 can be approximately 2.25 inches. The length of the tip 116 can be a length from a point of the tip to a position on the fluke 112 where the fluke 112 narrows to the point.

The base of the anchor 100 can include a back plate 120 positioned on a back end of the anchor 100. The back plate 120 can be attached to the back end of the base of the anchor 100 via a number of different attachment methods (e.g., metal weld, adhesive, bolts, pins, etc.). In some embodiments, the back plate 120 can also be attached to the shank 102 as described herein. The back plate 120 can be positioned to collect debris (e.g., sand, dirt, mud, rocks, etc.) in the first portion 106 and/or second portion 110 of the base. That is, debris can be scooped into the first portion 106 of the anchor 100 and the back plate 120 can prevent the debris from passing over the base creating additional resistance when the anchor 100 is being pulled across the debris.

In some embodiments, the back plate 120 can extend along a bottom portion of the anchor 100 at or near the first level. For example, the back plate 120 can extend from a right side of the base to a left side of the base. In some embodiments, a portion of the back plate 120 can extend from the right side of the base to the left side of the base at a position that is the same and/or similar to the first level 106 of the base. That is, the back plate 120 can be positioned at the same level as the first level of the base along the back end of the anchor 100. Thus, the back plate 120 can be at the same level as the first level and below the level of the second level along the back end of the anchor 100.

In some embodiments, the back plate 120 can extend below the second level of the base and can act as a back stop below the second level of the base. That is, the back plate 120 can act as a back stop below the second level to prevent debris from passing past the base of the anchor 100 below the second level of the base similar to how the back plate 120 can act as a back stop to prevent debris from passing past the top of the base in the first portion 106 of the base.

In some embodiments, the back plate 120 can extend below the second level of the base a distance 128 between 40 millimeters and 30 millimeters. In a specific embodiment, the back plate 120 can extend below the second level a distance 128 of approximately 35 millimeters. In some embodiments, the back plate 120 can extend below the second level of the base to receive debris and provide additional pressure on the tip 116 of the fluke 112 when force is applied to a link receiver 104 (e.g., hole to attach a rode, etc.) of the fixed shank 102. That is, the force from the debris can apply additional force on the tip 116 of the fluke 112 and/or the first portion 106 of the base to insert the tip 116 and/or first portion 106 of the base into debris. In some examples, the force that is applied to the link receiver 104 can be a force of an object (e.g., boat, truck, all-terrain vehicle (ATV), etc.) pulling the anchor via a rode attached to the link receiver 104. In some examples, the anchor 100 can be utilized as a boat anchor to prevent a boat from changing position while on the water. In other examples, the anchor 100 can be utilized as a land anchor or recovery anchor that can be utilized to move vehicles with a winch or other device. That is, the anchor 100 can be utilized to provide resistance for a number of different purposes.

In some embodiments, the fixed shank 102 can include a removal link receiver 134. In some embodiments, the removal link receiver 134 can be located above a front end of the base of the anchor 100. The removal link receiver 134 can be utilized to remove the flukes 114 and/or base from debris. In some embodiments, a rode can be attached to the removal link receiver 134 and attached to the link receiver 104 by a detachable link (not shown). The detachable link can couple the rode to the link receiver 104 and can be detached from the link receiver 104 when a threshold of pressure is applied to the detachable link. In one example, the detachable link can be a zip tie or plastic link that can be detached by breaking the zip tie or plastic link.

In various embodiments, the anchor 100 can include a roll bar 122 that can be positioned from a right side of the anchor 100 to a left side of the anchor 100. In some embodiments, the roll bar 122 can extend from a first side of the back plate 120 to a second side of the back plate 120. The roll bar 122 can be attached to a number of tabs 140 that are attached to the base of the anchor 100. The roll bar 122 can be attached to the tabs 140 by a number of releasable pins 126 (e.g., bolt and nut, etc.). The number of releasable pins 126 can be utilized to stabilize the roll bar 122 while in use.

The roll bar 122 can also be attached to the base of the anchor 100 with an additional releasable pin 124 that attaches the roll bar 122 to at least one of the number of tabs 140. The additional releasable pin 124 can be removed to create a more compact structure for storing the anchor 100. For example, the additional releasable pin 124 can be removed and the roll bar 122 can rotate on the releasable pins 126 to a position that rests on the shank 102 or to a position that is behind the back plate 120. Though not shown in FIG. 1, an additional releasable pin can be located on an opposite side of releasable pin 126 to attach the roll bar 122 to a tab that is located opposite of tab 140.

In some embodiments, the number of tabs 140, the back plate 120, the elevated portion 110 of the base, and/or the plate portion 136 of the shank 102 can be bent into position. For example, a single piece of material (e.g., steel, metal, anchor material, etc.) can be bent in a number of ways to provide the angles of the base, back plate 120, and/or tabs 119, as described herein. In some embodiments, the roll bar 122 can be attached to the number of tabs 140 via a permanent or semi-permanent method of attachment (e.g., metal weld, adhesive, etc.).

The roll bar 122 can prevent the anchor 100 from flipping over during use. That is, the anchor 100 can be more productive when the shank 102 of the anchor 100 is on a top side of the base. In some embodiments, the anchor 100 is attached to an object (e.g., boat, etc.) and changes in position of the object can cause the anchor 100 to roll over on the top side of the anchor 100. The roll bar 122 can prevent the anchor from rolling over on to the top side of the anchor 100 and remaining on the top side of the anchor 100.

A force from an object can be exerted on the anchor 100 at the shank 102 via a rode (e.g., rope, chain, etc.) coupled to the receiver link 104 to cause the tip 116 of the flukes 112 to be inserted into debris (e.g., ground, sand, dirt, clay, rocks, etc.) that is in front of the flukes 112. The first portion 106 of the base can be inserted into the ground when the flukes 112 are inserted into the ground and debris from the ground can be collected on top of the base and stopped (e.g., collected, built up, etc.) by the back plate 120.

In some embodiments, the flukes 112 can be positioned at a downward angle 130 from the base of the anchor 100. In some embodiments, the downward angle 130 can be between approximately 5 degrees and 20 degrees. In a specific embodiment, the downward angle 130 can be approximately 10 degrees. The downward angle 130 can be important for the functionality of the anchor 100. For example, when the downward angle 130 is larger than a threshold, the anchor 100 may skip or not set when a force is applied to the shank 102. In another example, when the downward angle 130 is below a threshold, the flukes 112 of the anchor may not set into the ground below the flukes 112. That is, when the downward angle 130 is below a threshold (e.g., 0 degrees, etc.), the flukes 112 and/or the tip 116 may not make contact with the ground and not be able to penetrate the ground below the flukes 112 as efficiently.

The position of the flukes 112 on the second portion 110 of the base can create a downward angle 130 from the base of the anchor 100 to the tip 116 of the flukes 112. The downward angle of the flukes 112 can direct the flukes 112 into the ground with a relatively small amount of force applied to the shank 102. That is, the downward angle of the flukes 112 can enable a relatively smaller force to set the anchor 100 compared to previous anchors.

Figure 2:
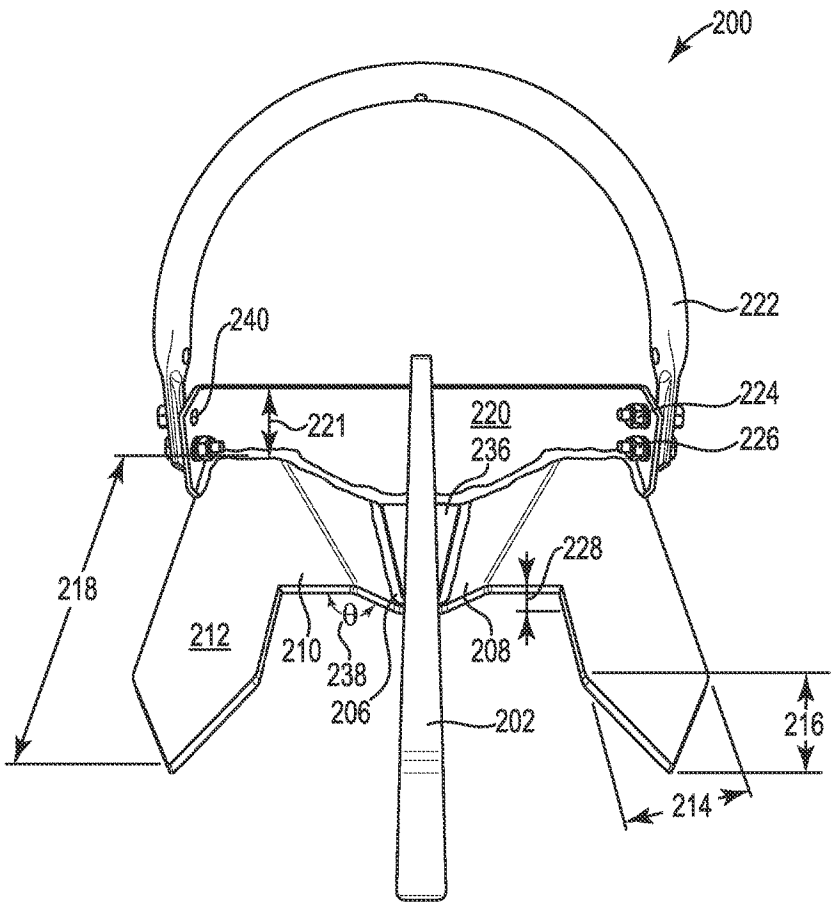
FIG. 2 illustrates an example of a front view of an anchor in accordance with one or more embodiments of the present disclosure.

FIG. 2 illustrates an example of a front view of an anchor 200 in accordance with one or more embodiments of the present disclosure. FIG. 2 illustrates an example of an anchor 200 that is similar to anchor 100 as referenced in FIG. 1. For example, FIG. 2 can illustrate anchor 100 as referenced in FIG. 1 from a front view.

The anchor 200 can include a fixed shank 202 that extends from a first portion 206 beyond a front end of the anchor 200. As described herein, the fixed shank 202 can be attached to the first portion 206 of the base by a plate 236. The plate 236 can provide a greater attachment strength to the first portion 206 of the base of the anchor 200.

In some embodiments, the fixed shank 202 can be attached to the first portion 206 of the base via a number methods (e.g., metal weld, adhesive, bolts, pins, etc.) to permanently or semi-permanently attach the shank 202 to the first portion 206 of the base. As described herein, the anchor 200 can include a base with a first portion 206 at a first level and a second portion 210 at a second level.

In some embodiments, the first portion 206 of the base can be raised to a second portion 210 of the base by a raised portion 208. The first portion 206, raised portion 208, and second portion 210 can be positioned to form a trench to collect debris when a force is applied to the fixed shank 202. In some embodiments, the raised portion 208 can be at an angle 238 from the first portion 206. In certain embodiments, the angle 238 can be between approximately 0 degrees and 45 degrees. In some embodiments, the angle 238 can be between approximately 20 degrees and 40 degrees from the first portion 206. In a specific embodiment, the angle 238 can be approximately 30 degrees from the first portion.

In some embodiments, the anchor 200 can include a back plate 220 that is attached to a back end of the anchor 200. In some embodiments, the back plate 220 can be positioned to cover a distance 221 above the second portion 210 of the anchor 200. In some embodiments, the distance 221 can be between approximately 35 millimeters and 55 millimeters. In a specific embodiment, the distance 221 can be approximately 45 millimeters. In some embodiments, the distance 221 of the back plate 220 can help provide resistance when debris enters the base of the anchor 200 from the front end of the anchor 200.

In some embodiments, the anchor 200 can include a number of flukes 212. The number of flukes 212 can be positioned at the second level of the second portion 210. As described herein, the number of flukes 212 can each include a tip 216 that is triangle shaped with a point for puncturing debris. The tip 216 can have a length that is equal to or similar to a width 214 of the number of flukes 212. For example, the width 214 of the number of flukes 212 can be approximately 60 millimeters and the length of the tip 216 can be approximately 60 millimeters. In this example, the tip 216 can be measured from the point of the tip 216 to a position where the tip 216 begins to narrow towards the point of the tip 216.

In some embodiments, the second portion 210 can be a distance 228 above the first portion 206. In some embodiments, the distance 228 can be between approximately 10 millimeters to 25 millimeters. In a specific embodiment, the distance 228 can be approximately 18 millimeters. The distance 228 of the second portion 210 can direct a greater quantity of debris to enter the front end of the anchor into the area of the first portion 206. That is, the distance 228 can allow debris to move under the second portion 210. As described herein, the debris that is allowed to move under the second portion can be stopped by the back plate 220 that extends below the second portion 210. The debris that is allowed to move under the second portion can apply pressure to the bottom portion of the back plate 220 to provide a force that can direct the flukes 212 and/or first portion 206 of the base into the debris below the anchor 200.

In some embodiments, the flukes 212 can be permanently fixed to the second portion 210. In specific embodiments, the flukes can be integrally formed with the second portion 210 of the anchor 200. That is, a portion of material can be removed from the second portion 210 to form the shape and length of the flukes 212. In certain embodiments, the flukes 212 can be removable from the second portion 210. For example, the flukes 212 can be separate and distinct from the second portion and coupled to the second portion 210 via a number of removable pins (e.g., bolts, etc.).

In various embodiments, the anchor 200 can include a roll bar 222 that can be positioned from a right side of the anchor 200 to a left side of the anchor 200. In some embodiments, the roll bar 222 can extend from a first side of the back plate 220 to a second side of the back plate 220.

The roll bar 222 can be attached to a number of tabs 240 that are attached to the base of the anchor 200. The roll bar 222 can be attached to the tabs 240 by a number of releasable pins 226 (e.g., bolt and nut, etc.). The number of releasable pins 226 can be utilized to stabilize the roll bar 222 while in use. The roll bar 222 can also be attached to the base of the anchor 200 with an additional releasable pin 224 that attaches the roll bar 222 to at least one of the number of tabs 240. The additional releasable pin 224 can be removed to create a more compact structure for storing the anchor 200. For example, the additional releasable pin 224 can be removed and the roll bar 222 can rotate on the releasable pins 226 to a position that rests on the shank 202 or to a position that is behind the back plate 220. The roll bar 222 can also be attached to the anchor 200 in a number of additional ways. For example, the roll bar 222 can be attached to the back plate 220 at a number of different positions so that the roll bar 222 extends above a highest portion of the shank 202. In another example, the roll bar 222 can be attached to the first portion 206 or the second portion 210 of the base of the anchor 200.

In some embodiments, the number of tabs 240 can be integrally coupled to the back plate 220. That is, the number of tabs 240 can be part of the back plate 200. For example, the number of tabs 240 can be bent from the same piece of material (e.g., metal, etc.) as the back plate 220. When the number of tabs 240 are coupled to the back plate 220, the number of tabs 240 can also be coupled to the base of the anchor 200. For example, the number of tabs 240 can be welded to the second portion 210 of the anchor 200. The number of tabs 240 can provide additional strength to the back plate 220 when the number of tabs 240 are coupled to the second portion 210 or other area of the anchor 200.

Figure 3:
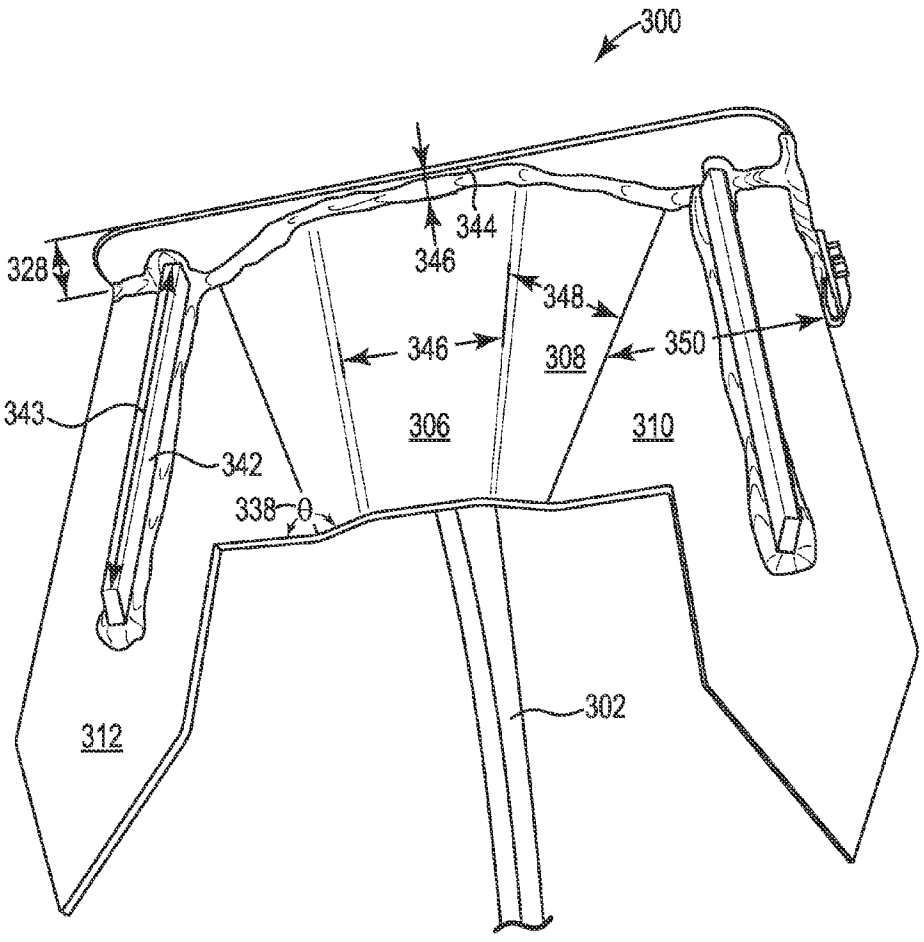
FIG. 3 illustrates an example bottom view of an anchor in accordance with one or more embodiments of the present disclosure.

FIG. 3 illustrates an example bottom view of an anchor 300 in accordance with one or more embodiments of the present disclosure. FIG. 3 illustrates an example of an anchor 300 that is similar to anchor 100 as referenced in FIG. 1 and/or anchor 200 as referenced in FIG. 2. FIG. 3 can illustrate anchor 100 as referenced in FIG. 1 from a bottom view. That is, the anchor 300 can illustrate a portion of the anchor 300 that is placed on a ground (e.g., lake bottom, ocean bottom, etc.) to be utilized for anchoring an object (e.g., boat, etc.).

The anchor 300 can include a fixed shank 302 that is attached to the top side of the first portion 306 of the base of the anchor 300. As described herein, the first portion 306 can be positioned at or near the ground when the anchor 300 is in an anchoring position (e.g., upright position, positioned with the roll bar at a top position, etc.). In some embodiments, the first portion can have a width 346. In some embodiments, the width 346 can increase from the front end of the anchor 300 to the back end of the anchor 300.

In some embodiments, the width 346 at the front end (e.g., front position of the first portion 306, position where the second portion 310 turns into a fluke 312, etc.) of the anchor 300 can be between approximately 30 millimeters and 50 millimeters. In a specific embodiment, the width 346 at the front end of the anchor 300 can be approximately 40 millimeters. In some embodiments the width 346 at the back end (e.g., position where the second portion 310 is attached to the back plate, etc.) of the anchor 300 can be between approximately 70 millimeters and 90 millimeters. In a specific embodiment, the width 346 at the back end of the anchor 300 can be approximately 80 millimeters. That is, in a specific embodiment the width 346 at the front end of the anchor 300 can be approximately 40 millimeters and the width 346 at the back end of the anchor 300 can be approximately 80 millimeters. Thus, the width 346 of the back end of the first portion 306 can be approximately double the width 346 of the front end of the first portion 306 of the anchor 300.

In some embodiments, the anchor 300 can include a raised portion 308 that connects the first portion 306 at a first level and the second portion 310 at a second level. The raised portion 308 can create a scoop within the area of the first portion 306. That is, the area of the first portion 306 can be utilized to receive debris from the front side of the anchor 300. In some embodiments, the raised portion 308 can include a distance 348 from the first portion 306 to the second portion 310. In some embodiments, the distance 348 can be between approximately 22 millimeters and 42 millimeters. In a specific embodiment, the distance 348 can be approximately 32 millimeters.

In some embodiments, the raised portion can be at an angle 338. In some embodiments, the angle 338 can be between approximately 20 degrees and 40 degrees. In a specific embodiment the angle 338 can be approximately 30 degrees.

In some embodiments, the anchor 300 can include a second portion 310. The second portion 310 can be parallel with the first portion 306 at a level (e.g., second level of the base, etc.) that is above the first portion 306. In some embodiments, the second portion 310 can have a width 350. The width 350 can be different at the front end of the anchor 300 than at the back end of the anchor 300.

In some embodiments, the width 350 of the second portion 310 at a front end (e.g., front position of the first portion 306, position where the second portion 310 turns into a fluke 312, etc.) of the anchor 300 can be between approximately 80 millimeters and 120 millimeters. In a specific embodiment, the width 350 of the second portion 310 at the front end of the anchor 300 can be approximately 100 millimeters. In some embodiments, the width 350 of the second portion 310 at a back end (e.g., position where the second portion 310 is attached to the back plate, etc.) of the anchor 300 can be between approximately 30 millimeters and 50 millimeters. In a specific embodiment, the width 350 of the second portion 310 at a back end of the anchor 300 can be approximately 40 millimeters. That is, in a specific embodiment, the width 350 at the front end of the anchor 300 can be approximately 100 millimeters and the width 350 at the back end of the anchor 300 can be approximately 40 millimeters. Thus, the width 350 of the back end of the second portion 310 can be approximately half the width 350 of the front end of the second portion 310 of the anchor 300.

In some embodiments, the anchor 300 can include a reinforcement tab 342. The reinforcement tab 342 can provide additional strength to the number of flukes 312 and second portion 310 of the anchor 300. For example, the reinforcement tab 342 can prevent bending of the number of flukes 312. In some embodiments, the reinforcement tab 342 can extend from the back plate 320 to a position under the fluke 312.

In some embodiments, the reinforcement tab 342 can be attached to the bottom portion of the second portion 310, the bottom portion of the fluke 312, and/or the back plate 320. In some embodiments, the reinforcement tab 342 can provide additional strength to the back plate 320 when the reinforcement tab 342 is attached to the back plate 320. For example, the reinforcement tab 342 can prevent the back plate 320 from bending when the back plate 320 comes into contact with debris as described herein.

In some embodiments, the reinforcement tab 342 can have a distance 343. The distance 343 can be between approximately 140 millimeters and 180 millimeters. In a specific embodiment, the distance 343 can be approximately 160 millimeters. A number of different distances 343 can be utilized for the reinforcement tab 342 depending on a strength of the material utilized for the anchor 300 and/or the length of the flukes 312. The number of flukes 312 can utilize a number of different or additional strengthening techniques. For example, the number of flukes can include a gusset (not shown) or rib strengthening punch (not shown) to provide additional strength for a particular use.

In some embodiments, the anchor 300 can include a back plate 320. In some embodiments, the back plate 320 can be at the same level 344 as the first portion 306 of the anchor 300. In some embodiments, the back plate 320 can be at a different level than the first portion 306. For example, the back plate 320 can be a distance 346 from the first portion 306. In some embodiments, the distance 346 can be between approximately 0 millimeters to 15 millimeters. In a specific embodiment, the distance 346 can be approximately 5 millimeters. In some embodiments, the distance 346 of the back plate 320 can be utilized to receive debris. The received debris can apply pressure to the tips of the flukes 312 as described herein.

In some embodiments, the anchor 300 can include a back plate 320 that can extend below the second portion 310. In some embodiments, the back plate 320 can extend below the second portion 310 for a distance 328. In some embodiments, the distance 328 can be between approximately 20 millimeters and 40 millimeters. In a specific embodiment, the distance 328 can be approximately 33 millimeters. The distance 328 of the back plate 320 below the second portion 310 can be utilized to receive debris below the second portion 310 as described herein.

Figure 4:
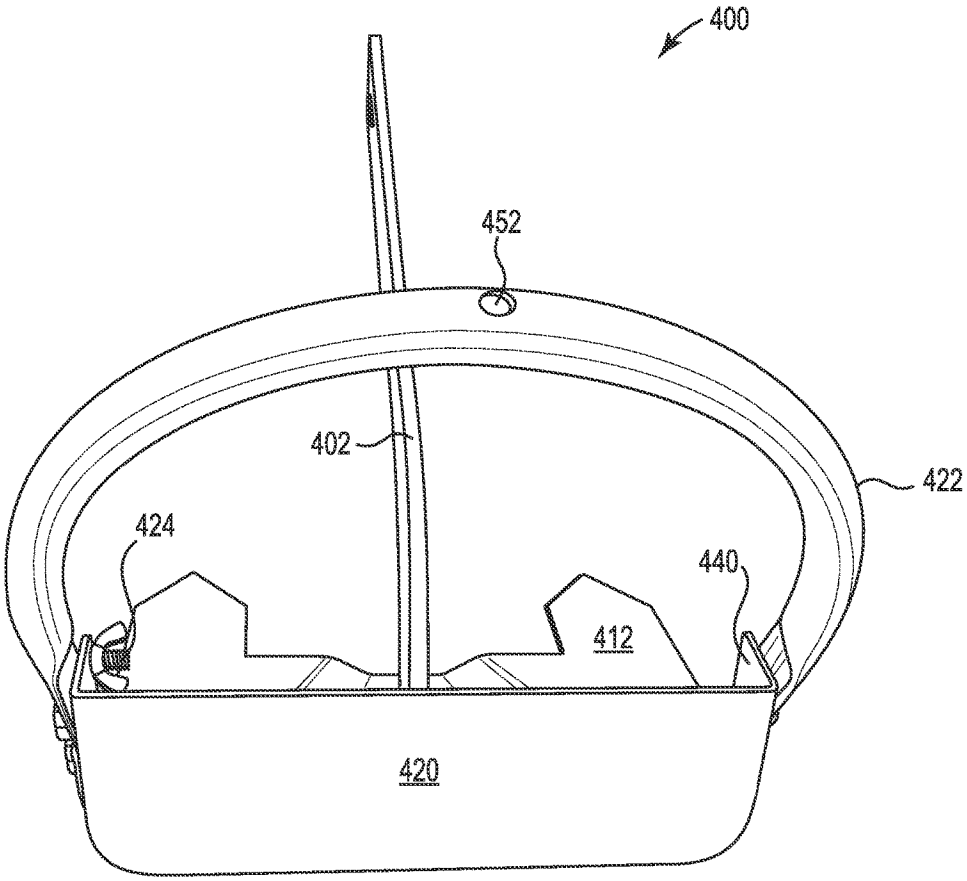
FIG. 4 illustrates an example back view of an anchor in accordance with one or more embodiments of the present disclosure.

FIG. 4 illustrates an example back view of an anchor 400 in accordance with one or more embodiments of the present disclosure. FIG. 4 illustrates an example of an anchor 400 that is similar to anchor 100 as referenced in FIG. 1, anchor 200 as referenced in FIG. 2, and/or anchor 300 as referenced in FIG. 3. For example, FIG. 4 can illustrate anchor 100 as referenced in FIG. 1 from a back view.

As described herein, the anchor 400 can include a fixed shank 402, a number of flukes 412, a number of tabs 440, a back plate 420, and/or a roll bar 422. In some embodiments, the roll bar 422 can be attached to the number of tabs 440 via a removable pin 424. As described herein, the removable pin 424 can be utilized to put the roll bar 422 in an anchoring position and/or a storage position as described herein. For example, an anchoring position can be a position where the anchor 400 can function as descried herein (e.g., bottom portion placed on the ground, roll bar with the removable pin 424 in place, etc.). In another example, a storage position can be a position where the anchor 400 is put into a compact position that may not provide all of the functionality as described herein (e.g., removable pin 424 removed, roll bar may not be functional, etc.).

In some embodiments, the anchor 400 can include a receiver 452. The receiver 452 can include an aperture (e.g., hole, etc.) that can be utilized to store the anchor 400 when not in use. In some embodiments, the receiver 452 can be utilized lock the anchor 400 in a storage position. For example, the anchor 400 can be positioned on the back plate 420 and the receiver 452 can be utilized to lock the anchor 400 in the storage position. In some embodiments, the receiver 452 can be utilized to couple the roll bar 422 to a pin (e.g., bolt, latch pin, etc.). That is, a latch pin can be utilized with the receiver 452 to secure the anchor 400 when the anchor is positioned on the back plate 420.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above elements and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. An anchor, comprising:

a base comprising:

a first portion that is positioned at a first level, wherein a centerline of the base runs through the first portion;

a second portion that is positioned at a second level on a first side of the centerline of the first portion;

a third portion that is positioned at the second level on a second side of the centerline of the first portion; and a back plate coupled to a back end of the first portion, the second portion, and the third portion, wherein the back plate extends over an area between the first level and the second level, extends over an area above the second level, extends from the second portion to the third portion, and covers a portion below the first level.

2. The anchor of claim 1, wherein the back end comprising the back plate is elevated from a front end of the base.

3. The anchor of claim 1, wherein the back plate is substantially perpendicular to the first portion and the second portion.

4. The anchor of claim 1, comprising a fixed shank coupled to the first level that is elevated from the base at an angle of approximately 15 degrees above the first level of the base.

5. The anchor of claim 1, wherein the back plate extends along a bottom portion of the anchor at the first level.

6. The anchor of claim 1, wherein the back plate covers a portion below the second level.

7. An anchor, comprising:

a base comprising a first portion that is positioned at a first level and a second portion that is positioned at a second level that is elevated from the first level;

at least two fixed flukes attached to the base at the second level, wherein one of the at least two flukes is attached to the second portion of the base such that a part of a tip of the fluke is positioned at the first level; and a fixed shank that is attached to the base at the first level.

8. The anchor of claim 7, wherein the tip of the at least two flukes are the same size as a width of the at least two flukes.

9. The anchor of claim 8, wherein the width of the at least two flukes are consistent from the second portion of the base to a start of the tip.

10. The anchor of claim 7, wherein a roll bar is attached above the back plate.

11. The anchor of claim 7, wherein the fixed shank is attached to the base with a plate that is coupled to the fixed shank and the base at the first level.

12. The anchor of claim 7, comprising a back plate coupled to a back end of the first portion of the base to cover the back end between the first portion of the base and the second portion of the base.

13. The anchor of claim 12, wherein the back plate extends below the first portion of the base to cover a portion of the back end below the first portion of the base.

14. The anchor of claim 13, wherein the back plate extends above the second portion of the base to cover a portion of the back end above the second portion of the base.

15. An anchor, comprising:

a base comprising a back plate coupled to a back end of the base, wherein the base includes a lower portion between a raised portion;

at least two flukes attached to the raised portion of the base, wherein the at least two flukes have a uniform shaft portion width and a tip portion, wherein a part of the tip portion is positioned at a level of the lower portion of the base; and a fixed shank attached to the lower portion of the base, wherein the fixed shank includes a link receiver that is positioned on the fixed shank opposite from the lower portion of the base.

16. The anchor of claim 15, wherein the fixed shank is fixed at an angle of approximately 15 degrees above the lower portion of the base.

17. The anchor of claim 15, wherein the back plate is positioned at a level that is the same as the lower portion of the base and covers a portion of the back end below the raised portion of the base.

18. The anchor of claim 15, wherein the fixed shank is attached to the back plate.

19. The anchor of claim 15, comprising a roll bar attached to a number of tabs coupled to the raised portion of the base, wherein the roll bar comprises a removable pin for adjusting a position of the roll bar.

* * * * *